US010935238B2

(12) United States Patent
Anwar

(10) Patent No.: US 10,935,238 B2
(45) Date of Patent: Mar. 2, 2021

(54) FURNACE WITH PREMIX ULTRA-LOW NOX (ULN) BURNER

(71) Applicant: Carrier Corporation, Palm Beach Gardens, FL (US)

(72) Inventor: Fahad Anwar, Avon, IN (US)

(73) Assignee: CARRIER CORPORATION, Palm Beach Gardens, FL (US)

( * ) Notice: Subject to any disclaimer, the term of this patent is extended or adjusted under 35 U.S.C. 154(b) by 64 days.

(21) Appl. No.: 16/420,771

(22) Filed: May 23, 2019

(65) Prior Publication Data

US 2019/0360691 A1 Nov. 28, 2019

Related U.S. Application Data

(60) Provisional application No. 62/675,349, filed on May 23, 2018.

(51) Int. Cl.
*F23D 5/12* (2006.01)
*F23N 5/24* (2006.01)
(Continued)

(52) U.S. Cl.
CPC ..... *F23N 5/242* (2013.01); *F23N 1/022* (2013.01); *F23N 3/002* (2013.01); *F23N 5/265* (2013.01); *F23N 2227/02* (2020.01)

(58) Field of Classification Search
CPC ..... F23N 5/242; F23N 1/022; F23N 1/025; F23N 3/002; F23N 3/005; F23N 5/265; F23N 2227/02; F23N 2237/16; F23N 1/002; F23N 2225/08; F23N 2227/00; F23N 2233/04; F23N 2233/10; F23N 2235/12; F23N 2237/10; F23N 2241/08; F23N 3/082; F23N 5/203; F23N 2227/10; F23N 2237/02; F23N 5/022; F23N 5/123; F23N 1/02; F23N 1/045; F23N 2221/00; F23N 2221/08; F23N 2225/04; F23N 2227/04; F23N 2227/22; F23N 2227/26;
(Continued)

(56) References Cited

U.S. PATENT DOCUMENTS 4,373,662 A 2/1983 Bassett et al.
4,982,721 A 1/1991 Lynch
(Continued)

FOREIGN PATENT DOCUMENTS

WO 9607056 A1 3/1996

*Primary Examiner* — Jason Lau
(74) *Attorney, Agent, or Firm* — Cantor Colburn LLP

(57) ABSTRACT

Disclosed is an induced-draft gas-fired furnace that includes: an electronic furnace controller, a burner assembly, a gas valve, and an inducer motor, wherein the controller: accelerates the inducer motor at a first pre-ignition rate to a first pre-ignition speed; controls the gas valve to supply gas to the burner assembly to obtain a first pre-ignition ratio of fuel to air, operates an igniter to attempt to ignite the first fuel mixture, determines whether fuel has ignited in the burner assembly, wherein when fuel having the first pre-ignition ratio of fuel to air remains unignited after a plurality of ignition attempts, the controller: decelerates the inducer motor to a second pre-ignition rate to obtain a second pre-ignition speed and a second fuel mixture comprising a second pre-ignition ratio of fuel to air, and determines whether the second fuel mixture has ignited in the burner assembly.

20 Claims, 4 Drawing Sheets

(51) Int. Cl.
*F23N 3/00* (2006.01)
*F23N 5/26* (2006.01)
*F23N 1/02* (2006.01)

(58) Field of Classification Search
CPC ..... F23N 2227/36; F23N 2229/02; F23N 2229/12; F23N 2229/20; F23N 2239/04; F23N 2241/04; F23N 3/00; F23N 5/00; F23N 5/02; F23N 5/082; F23N 5/12; F23N 5/184; F23N 5/187; F23N 5/24; F28D 2021/0022; F28D 7/10; F28D 7/16; F23D 14/04; F23D 23/00; F23D 91/02; F23D 14/14; F23D 14/02; F23D 2209/30; F23D 14/10; F23D 14/145; F23D 14/16; F23D 14/22; F23D 14/56; F23D 14/58; F23D 14/586; F23D 14/60; F23D 14/70; F23D 17/002; F23D 2203/104; F23D 2204/10; F23D 2207/00; F23D 2208/10; F23D 2900/00014; F23L 17/005; F23L 15/02; F23L 17/16; F24D 19/1084; F24D 19/1087; F24D 2200/18; F24D 12/02; F24D 2200/046; F24D 2200/22; F24D 2220/06; F24D 5/04; F27B 17/00; F24H 9/2085; F24H 3/087; F24H 9/2071; F24H 3/006; F24H 3/0488; F24H 3/105; F24H 9/1881; F24H 9/2035; F24H 9/2064; F24H 3/06; F24H 3/065; F24H 1/186; F24H 3/12; F24H 8/00; F24H 9/1836
See application file for complete search history.

(56) References Cited

U.S. PATENT DOCUMENTS

| | | | | |
|---|---|---|---|---|
| 5,074,780 | A | 12/1991 | Erdman | |
| 5,076,780 | A | 12/1991 | Erdman | |
| 5,078,317 | A * | 1/1992 | Kenner | F23N 5/203 237/2 A |
| 5,112,217 | A | 5/1992 | Ripka et al. | |
| 5,676,069 | A | 10/1997 | Hollenbeck | |
| 5,732,691 | A | 3/1998 | Maiello et al. | |
| 5,791,332 | A | 8/1998 | Thompson et al. | |
| 5,806,440 | A | 9/1998 | Rowlette et al. | |
| 6,377,426 | B2 | 4/2002 | Hugghins et al. | |
| 6,535,838 | B2 | 3/2003 | Abraham et al. | |
| 6,543,438 | B1 | 4/2003 | Roetken et al. | |
| 6,877,462 | B2 | 4/2005 | Adams et al. | |
| 7,293,718 | B2 | 11/2007 | Sigafus | |
| 8,177,544 | B2 | 5/2012 | Anderson | |
| 8,807,987 | B2 | 8/2014 | Lehman et al. | |
| 9,228,758 | B2 | 1/2016 | Hugghins | |
| 9,291,355 | B2 | 3/2016 | Hugghins | |
| 9,500,366 | B2 | 11/2016 | Kadah et al. | |
| 9,618,231 | B2 | 4/2017 | Kowald et al. | |
| 2004/0220777 | A1 | 11/2004 | St. Jean et al. | |
| 2008/0127963 | A1 | 6/2008 | Thompson | |
| 2011/0309155 | A1 | 12/2011 | Thompson | |
| 2013/0230812 | A1 * | 9/2013 | Schultz | F24H 3/065 431/12 |
| 2014/0030662 | A1 * | 1/2014 | Noman | F24H 3/105 431/12 |
| 2014/0088918 | A1 | 3/2014 | Miller et al. | |
| 2015/0088918 | A1 | 3/2015 | Glasgow et al. | |
| 2018/0259223 | A1 * | 9/2018 | Reed | F24H 3/006 |

* cited by examiner

FURNACE WITH PREMIX ULTRA-LOW NOX (ULN) BURNER

CROSS-REFERENCE TO RELATED APPLICATIONS

This application claims the benefit of U.S. provisional application 62/675,349 filed May 23, 2018, which is incorporated herein by reference in its entirety.

BACKGROUND

Exemplary embodiments pertain to the art of igniting furnace burners and more specifically to igniting a premix ultra-low NOx (ULN) burner.

In a furnace, when one of the sensors identifies an unsafe condition, the furnace controller may shut off fuel and power to prevent unsafe operation. Common causes of furnace lock-outs may be a defective igniter, defective flame sensor or an inappropriate quality of gas supply. When the furnace attempts to start, a furnace controller may check for igniter action and for the presence of flame. If the igniter does not activate within a few seconds, the furnace controller may stop the ignition sequence. The controller may retry the ignition sequence several (such as three) additional times before going into a lock-out state. Furnaces may remain in the locked-out state until power to the furnace is manually reset.

The American National Standards Institute (ANSI) gas standard Z21.47 titled "Gas Fired Central Furnaces" (the "standard") applies to automatically operating gas-fired central furnaces ("furnaces"), for installation in residential, commercial, and industrial structures including furnaces for direct vent, recreational vehicle, outdoor, and manufactured (mobile) homes. The standard requires premix ultra-low NOx (NOx being oxides of nitrogen, a type of Greenhouse gas) burners, or ULN burners, in furnaces to successfully ignite without locking-out when receiving gas at a reduced rate (resulting in a reduced operating pressure) or receiving gas having a high heating value between (for example) 1100-1400 Btu/ft^3. Certain operational parameters for the furnace may be required to meet the requirements of the standard.

BRIEF DESCRIPTION

Disclosed is a furnace, the furnace being an induced-draft gas-fired furnace, the furnace including: a controller, the controller being an electronic furnace controller, a burner assembly, a gas valve, and an inducer motor, wherein the controller: accelerates the inducer motor at a first pre-ignition rate to a first pre-ignition speed; controls the gas valve to supply gas to the burner assembly to obtain a first pre-ignition ratio of fuel to air, operating an igniter to attempt to ignite the first fuel mixture, determines whether fuel having the first pre-ignition ratio of fuel to air has ignited in the burner assembly, wherein when fuel having the first pre-ignition ratio of fuel to air remains unignited after a plurality of ignition attempts, the controller: decelerates the inducer motor to a second pre-ignition rate to obtain a second pre-ignition speed and a second fuel mixture comprising a second pre-ignition ratio of fuel to air, and determines whether the second fuel mixture has ignited in the burner assembly.

In addition to one or more of the above features or as an alternative when fuel having the second pre-ignition ratio of fuel to air remains unignited in the burner assembly the controller locks out the furnace.

In addition to one or more of the above features or as an alternative when fuel having the first pre-ignition ratio of fuel to air has ignited in the burner assembly, the controller accelerates the inducer motor at a first post-ignition rate to obtain a first post-ignition speed and a first post-ignition fuel to air ratio, wherein the first post-ignition rate provides steady state acceleration, and wherein the controller controls the furnace to heat air with the inducer burner at the first post-ignition speed.

In addition to one or more of the above features or as an alternative when fuel having the second ratio of fuel to air has ignited in the burner assembly the controller accelerates the inducer motor at a second post-ignition rate to obtain a second post-ignition speed and a second post-ignition fuel to air ratio, accelerates the inducer motor at a third post-ignition rate to obtain a third post-ignition speed and a third fuel to air ratio, wherein the third-post ignition rate provides steady state acceleration, wherein the third post-ignition rate is less than the second post-ignition rate, and wherein the controller controls the furnace to heat air with the inducer motor at the third post-ignition speed.

In addition to one or more of the above features or as an alternative the first pre-ignition rate, the second pre-ignition rate and the second post-ignition rate have same magnitude.

In addition to one or more of the above features or as an alternative the first post-ignition rate and the third post-ignition rate have the same magnitude.

In addition to one or more of the above features or as an alternative the first post-ignition speed and the third-post ignition speed have the same magnitude.

In addition to one or more of the above features or as an alternative the first pre-ignition fuel to air ratio and the second post-ignition fuel to air ratio have the same magnitude.

In addition to one or more of the above features or as an alternative the burner assembly includes a premix ultra low NoX burner.

In addition to one or more of the above features or as an alternative the controller receives a pre-ignition call for heat before accelerating the inducer motor at the first pre-ignition rate to the first pre-ignition speed.

Further disclosed is a method of igniting a gas burner in a furnace, the furnace being an induced-draft gas-fired furnace, the furnace including one or more of the above disclosed steps and features.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
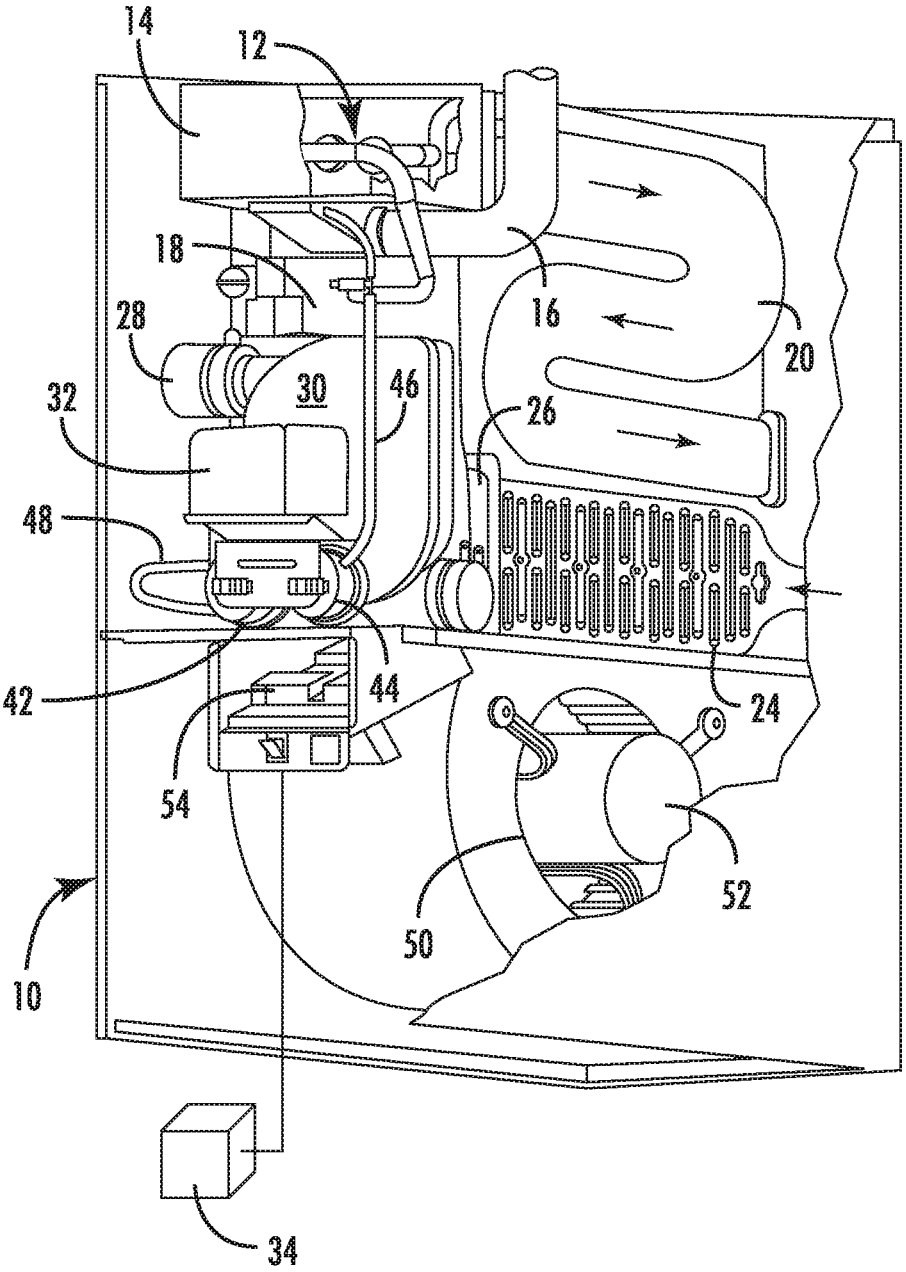
FIG. 1 is a perspective, cutaway view of a conventional two-stage furnace.

FIG. 1 is a perspective cutaway view of a conventional two-stage condensing furnace 10. The furnace illustrated in FIG. 1 is one type of furnace and is not intended on limiting the scope of application of the disclosed embodiments.

The furnace 10 may include a burner assembly 12, a burner box 14, an air supply duct 16 and a gas valve 18. The burner assembly 12 may be located within the burner box 14 and may be supplied with air through the air supply duct 16. Fuel gas may be supplied to the burner assembly 12 through a gas valve 18, and fuel may be ignited by an igniter assembly (not shown). The gas valve 18 may comprise a conventional solenoid-operated two-stage gas valve. The gas valve 18 for the two-stage furnace may have a closed state, a high open state associated with the operation of furnace 10 at its high firing rate, and a low open state associated with the operation of furnace 10 at its low firing rate.

The furnace 10 may include a heat exchanger assembly, which may include a plurality of heat exchangers including a primary or non-condensing heat exchanger 20 and a secondary or condensing heat exchanger 24. The furnace 10 may further include a condensate collector box 26, an exhaust vent 28, an induced draft blower 30 and an inducer motor 32. The inducer motor 32, one of a plurality of motors in the furnace 10, may drive the induced draft blower 30. Gases produced by combustion within the burner box 14 may flow through the plurality of heat exchangers, the condensate collector box 26 and may then be vented to the atmosphere through the exhaust vent 28. The flow of these gases, alternatively referred to as combustion gases, may be maintained by the induced draft blower 30.

The two-stage furnace 10 may further include a thermostat 34, a plurality of pressure switches including a low pressure switch 42 and a high pressure switch 44, and a plurality of pressure tubes including a first pressure tube 46 and a second pressure tube 48. Excess air levels in the furnace 10 may be kept within an acceptable lower limit in part by the low pressure switch 42. Excess air levels in the furnace 10 may be kept within an acceptable higher limit in part by the high pressure switch 44. To sense pressure at the inlet of the primary heat exchanger 20, the plurality of pressure switches may be connected to the burner box 14 through a pressure tube 46. To sense pressure at the outlet of the secondary heat exchanger 24, the plurality of pressure switches 42 and 44 may be connected to collector box 26 through the pressure tube 48.

The furnace 10 may further include a blower 50 and a blower motor 52. The blower motor 52, another of the plurality of motors in the furnace 10, may drive the blower 50. The blower 50 may draw in air, and air discharged from the blower 50, alternatively referred to as circulating air flow, may then pass over the plurality of heat exchangers in a counter-flow relationship to the flow of combustion air. The circulating airflow may be thereafter directed to a space to be heated through a duct system (not shown).

The plurality of motors may operate at a low speed when the furnace is operating at its low firing rate (low stage operation). The plurality of motors may operate at a high speed when the furnace is operating at its high firing rate (high stage operation). The plurality of motors may be designed to operate at continuously variable speeds. Alternatively for the two stage furnace 10 the plurality of motors may be designed to selectively operate and at a plurality of operating speeds including a steady state low operating speed and a steady state high operating speed.

The furnace 10 may include a furnace controller 54 that, in part, may selectively control the operating speed of the plurality of motors by generating and transmitting control signals. For example, depending on operating conditions, the furnace controller 54 may select a speed from the plurality of operating speeds for the plurality of motors. In addition, the furnace controller 54 may select a time, duration, ramp (acceleration) rate, and torque at which the plurality of motors accelerate to and decelerate from the selected speed.

The combustion efficiency of an induced-draft gas-fired furnace may be optimized by maintaining the proper ratio of the gas input rate and the combustion airflow rate. Generally, the ideal ratio may be offset somewhat for safety purposes by providing for slightly more combustion air (that is, excess air) than that required for optimum combustion efficiency. While FIG. 1 illustrates a condensing furnace (that is, a furnace that uses a heat exchanger assembly that includes primary and secondary heat exchangers), the accompanying disclosure may be also applicable to non-condensing furnaces (that is, furnaces that have heat exchanger assemblies with only a single heat exchanger unit).

In the following sample use cases, the furnace control 54 may determine the requirements from the low pressure switch 42 and high pressure switch 44 in response to call-for-heat signals received from the thermostat 34 in the space to be heated. From this determination the furnace control 54 may generate speed control signals to drive inducer motor 32.

In a first sample use case, when the thermostat 34 provides a call-for-heat signal to the furnace control 54, the furnace control 54 may determine that furnace 10 is to operate at the low firing rate. The furnace control 54 may accelerate the inducer motor 32 to a first pre-ignition speed. The first pre-ignition speed for the inducer motor 32 may be a first pre-ignition steady state speed that may corresponding to a first pre-ignition differential pressure for the heat exchanger assembly. The first pre-ignition differential pressure for the heat exchanger assembly may be sufficient to actuate the low pressure switch 42, but not the high pressure switch 44.

When the first differential pressure for the heat exchanger assembly has been sustained for a preset time, the gas valve 18 may actuate to its low open state. Under this condition, the gas valve 18 may supply gas at the low firing rate to the burner assembly 12. The gas is ignited and begins heating the combustion gases passing through the heat exchanger assembly. This heating may cause a change in the density of the combustion air which, in turn, may causes an increase in the differential pressure across the heat exchange assembly.

The speed of the inducer motor 32 may be then reduced to a first post-ignition speed. The first post-ignition speed for the inducer motor 32 is a first post-ignition steady state speed that corresponds to a first post ignition differential pressure for the heat exchanger assembly. The first post-ignition differential pressure for the heat exchanger assembly is somewhat lower than the first pre-ignition value.

After reducing the speed of inducer motor 32 to the first post-ignition speed, furnace control 54 may provide a signal that causes blower motor 52 to accelerate to a first post-ignition speed. The first post-ignition speed for the blower motor 52 may be a first steady state speed that corresponds to a circulating airflow at which the furnace 10 may be designed to operate during low stage operations.

In a second sample use case, when the thermostat 34 provides a call-for-heat signal to furnace control 54, the furnace control 54 may determine that furnace 10 is to operate at the high firing rate. The furnace control 54 may accelerate the inducer motor 32 to a second pre-ignition speed. The second pre-ignition speed for the inducer motor 32 may be a second pre-ignition steady state speed that may correspond to a second pre-ignition differential pressure for the heat exchanger assembly. The second pre-ignition speed for the inducer motor 32 may be sufficient to actuate both low pressure switch 42 and high pressure switch 44.

When the second pre-ignition differential pressure for the heat exchanger assembly has been sustained for a preset time, the gas valve 18 may be actuated to the high open state. Under this condition, the gas valve 18 may supply gas at the high firing rate to burner assembly 12. The gas may be ignited and begin heating the combustion gases passing through the heat exchanger assembly. This heating may cause a change in the density of the combustion gases which, in turn, may cause an increase in the differential pressure across the heat exchange assembly.

The speed of inducer motor 32 may then be increased (rather than decreased as in the first sample use case) to a second post-ignition speed to attain a second post-ignition steady state speed. The second post-ignition steady state speed may correspond to a second post-ignition differential pressure for the heat exchanger assembly that is somewhat higher than the pre-ignition value. After moving the speed of inducer motor 32 to the second post-ignition speed, furnace controller 54 may cause blower motor 52 to accelerate to a second blower motor speed. The second post-ignition speed for the blower motor 52 may be a second steady state speed that may correspond to the circulating airflow value at which furnace 10 is designed to operate.

In order to reduce the operating cost of furnace 10 by improving its annual fuel utilization efficiency (AFUE), the combustion airflow for furnace 10 may be adapted to provide for intermediate stages of operation between the low stage of operation and the high stage of operation. This may be accomplished by providing one or more additional pressure switches that actuate at heat exchanger pressure levels intermediate that of the plurality of pressure switches. Circuitry in the furnace controller 54, however, may be limited to two inputs on which the plurality of pressure switches may provide pressure signals related to the pressure in the heat exchanger assembly.

Figure 2:
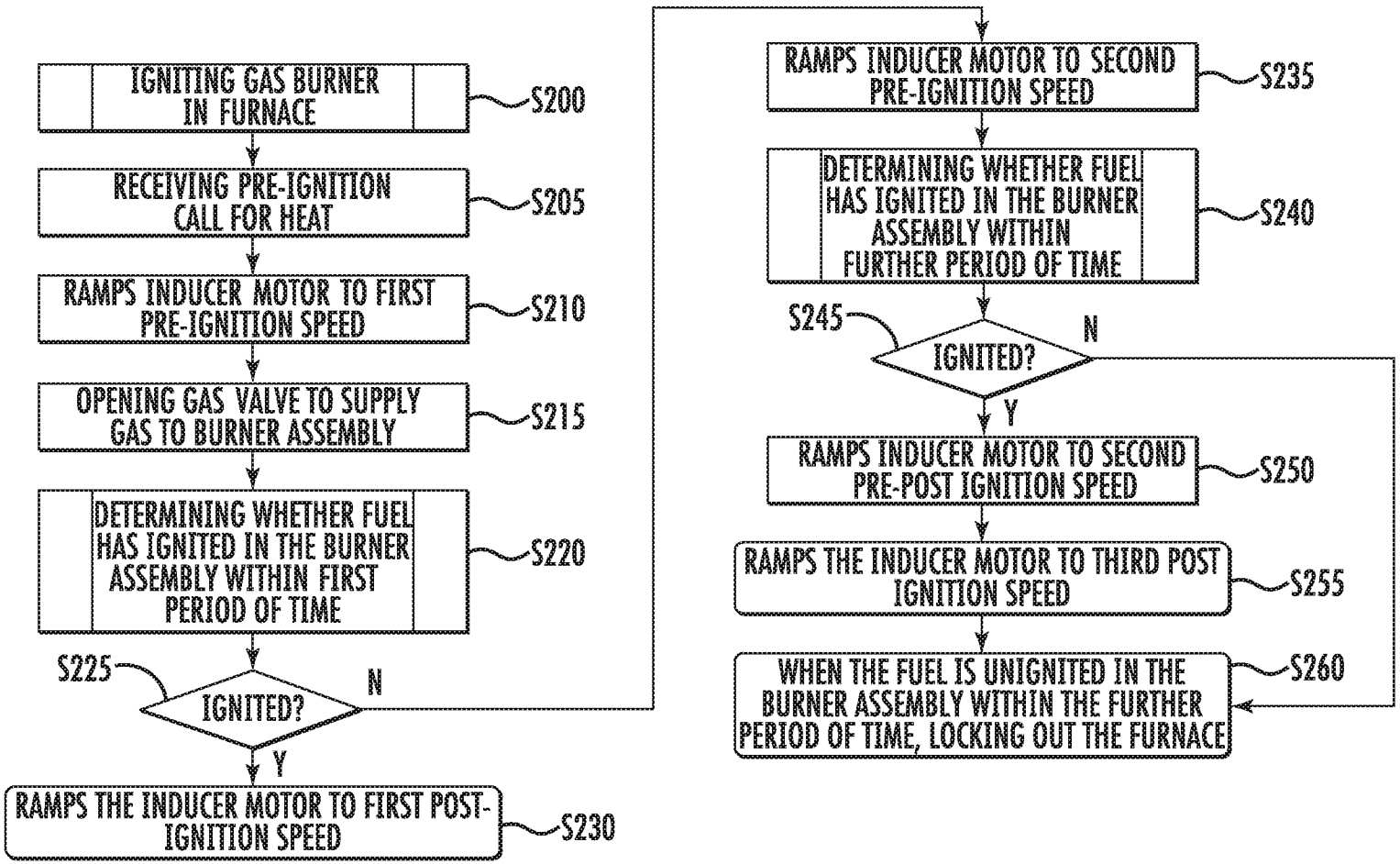
FIG. 2 illustrates a process for operating an inducer motor according to an embodiment.
Figure 3:
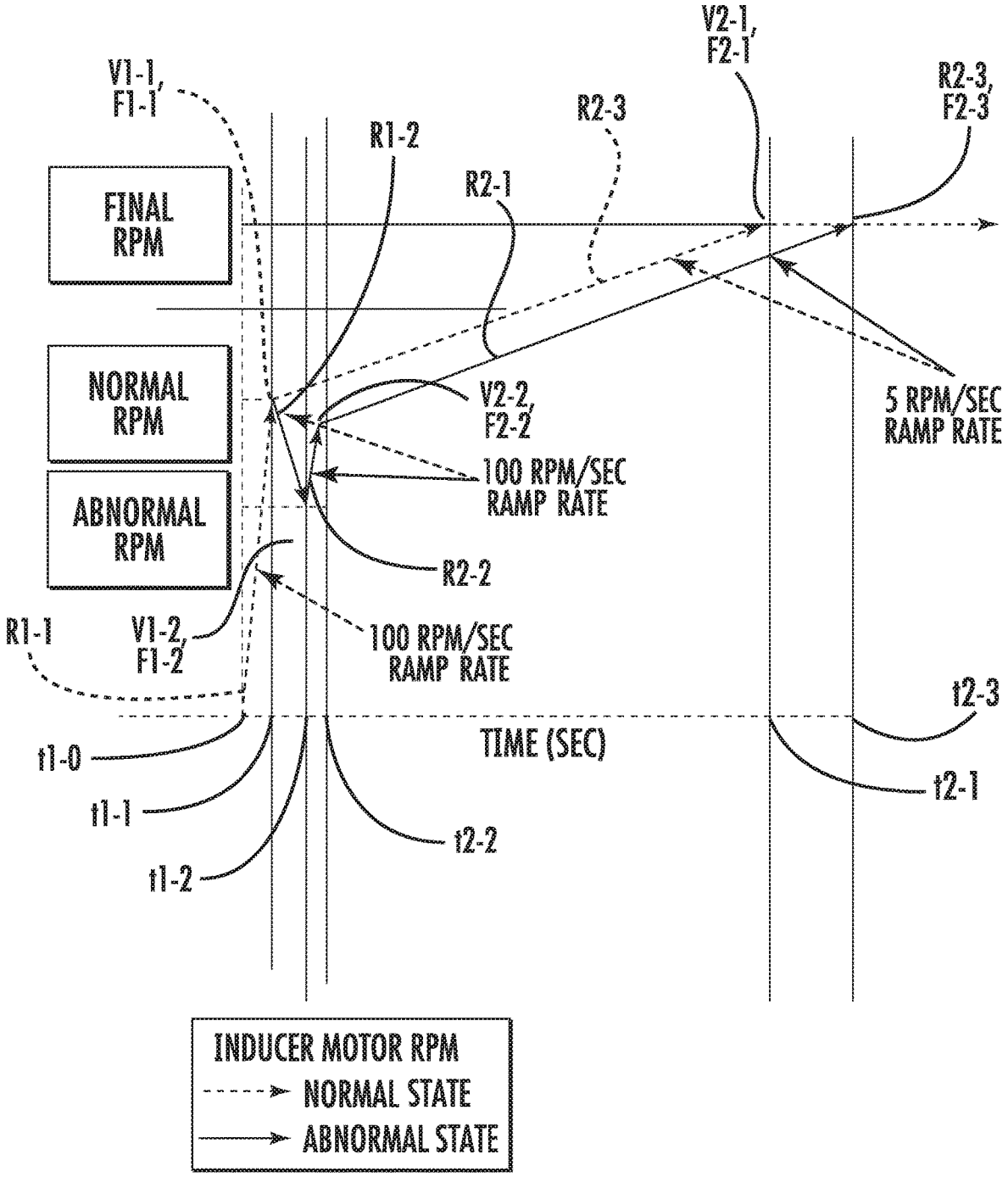
FIG. 3 graphically illustrates an operation of an inducer motor according to an embodiment.

Turning now to FIG. 1-3, disclosed is a method for igniting the furnace 10 with a pre-mix ultra-low NOx (ULN) burner after one or more failed attempts with gas being provided at a reduced rate (resulting in a reduced operating pressure) or receiving gas having a high heating value between, for example, 1100-1400 Btu/ft^3. The disclosed embodiments may avoid lockout and may be applied to existing systems without a need to replace hardware.

Specifically, a method or process of igniting the gas burner in a furnace 10 is illustrated generally under step S200. As indicated, the furnace 10 is a two-stage induced-draft gas-fired furnace 10, and the furnace 10 includes a furnace controller 54, hereinafter alternatively referred to as controller 54, a burner assembly 12, a gas valve 18 and an inducer motor 32. In FIG. 3, revolutions per minute (RPM) for the inducer motor is illustrated in the ordinate and time is illustrated in the abscissa. Time is represented as tx-y, where 'x' represents 0 for pre-ignition and 1 for post-ignition, while 'y' advances sequentially by reference to the time variable t. Similarly velocities of the inducer motor 32 are represented as Vx-y, ramp rates for the inducer motor 32 are represented as Rx-y, and fuel to air ratios obtained based on speed of the inducer motor 32 is represented by Fx-y.

The method comprises the controller 54 performing step S205 at time t1-0 of receiving a pre-ignition call for heat, and step S210 the controller 54 may accelerate the inducer motor 32 at a ramp rate R1-1 of 100 RPM/second for a first pre-ignition time t1-1 to obtain a first pre-ignition speed V1-1. The controller 54 may then perform step S215 at time t1-1 of opening gas the valve to supply gas to the burner assembly 12. At time t1-1, with the inducer motor 32 at V1-1, the first pre-ignition fuel to air ratio F1-1 may be appropriate to ignite successfully.

The method includes the controller 54 performing step S220 of determining whether fuel has ignited in the burner assembly 12. At step S225, if ignition has occurred then at step S230 the controller 54 may ramp (accelerate) the inducer motor 32 at a first post-ignition ramp rate R2-1 from t1-1 to t2-1 to reach a first post-ignition velocity of V2-1 to achieve a first post ignition fuel-air ratio F2-1. F2-1 may be used for heating air in the furnace 10 in order to heat the location that provided the call for heat. Ramp rate R2-1 may provide a steady state ramping to F2-1, which may require R2-1 to be significantly lower than R1-1. As illustrated R2-1 is 5 RPM/sec, which is significantly lower than R1-1, which is 100 RPM/sec, though the illustrated values are not limiting.

If the determination at step S225 is "no", indicating a failed ignition attempt then at step S235 the controller 54 may perform step S235 decelerating the inducer motor 32 at a second pre-ignition ramp rate of R1-2 between time t1-1 and t1-2 to reach a second pre-ignition velocity of V1-2 and achieve a second pre-ignition fuel to air ratio F1-2. The ramp-down rate R1-2 may have the same magnitude as R1-1. At this point, the furnace 10 may be running rich, that is, with less excess air than provided with the inducer motor 32 running at V1-1. The reduced excess air helps in successfully igniting fuel supplied under a relatively reduced gas pressure or an abnormal gas quality which may require a lower ignition speed or may require a mixture having excess air.

At step S240 the controller 54 performs step S240 of determining whether fuel has ignited in the burner assembly 12. If fuel has ignited then at step S245 the controller 54 may execute step S250 of ramping up the inducer motor 32 at a second post-ignition ramp rate R2-2 from t1-2 to t2-2 to reach a second post-ignition speed of V2-2 and a second post-ignition fuel to air ratio of F2-2. R2-2 may have the same magnitude as R1-1 to quickly lean out the fuel and avoid inefficient combustion. Similarly V2-2 may have the same magnitude as, or be close to, V1-1.

The controller 54 next executes step S255 of ramping the inducer motor 32 at a third post-ignition ramp rate R2-3 from time t2-2 to t2-3 to obtain a third post-ignition speed V2-3 and a third fuel to air ratio F2-3. F2-3 will be used for heating air in the furnace 10 in order to heat the location that provided the call for heat. Ramp rate R2-3 may have the same magnitude as R2-1 to provide a steady state ramping for a normal, steady state fuel burn and F2-3 may have the same value as F2-1 because at this point the furnace 10 is expected to be operating normally.

Figure 4:
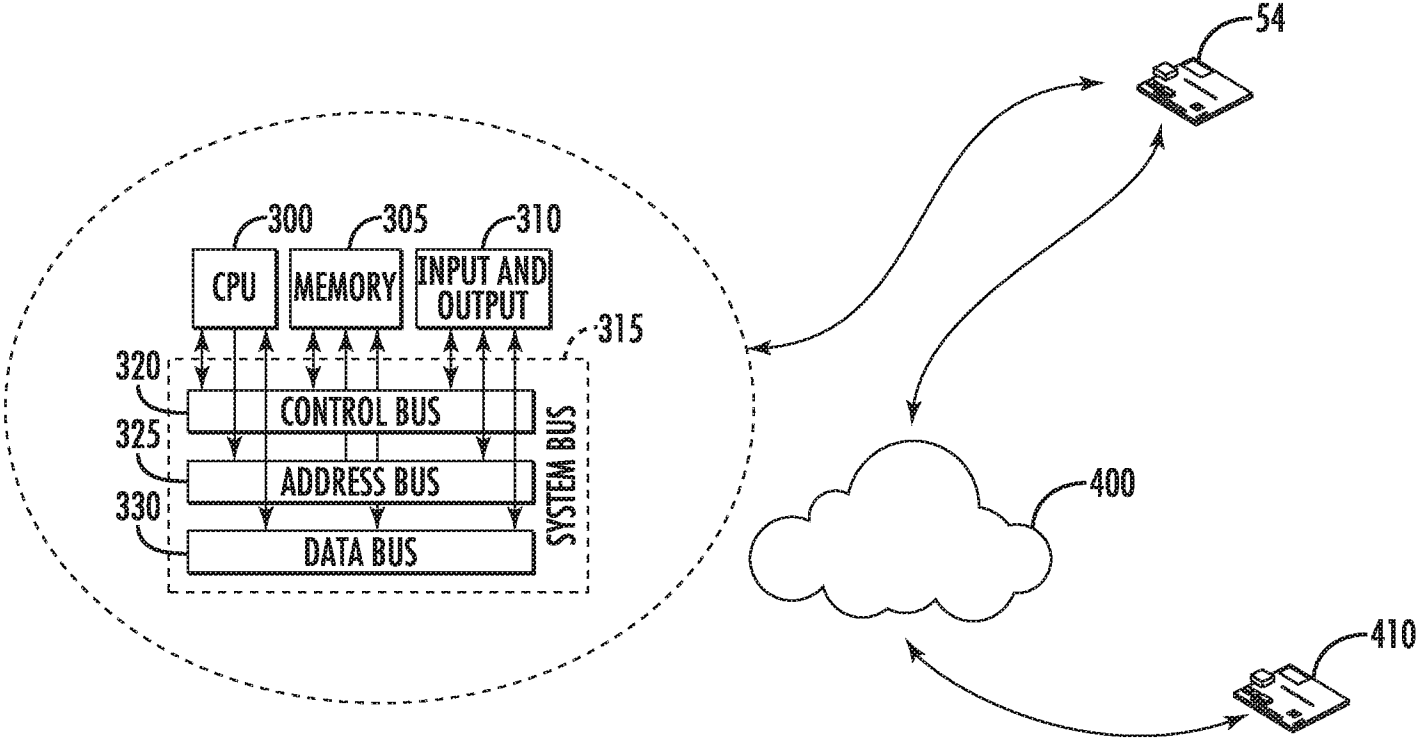
FIG. 4 illustrates technical features associated with a controller in a disclosed embodiment.

Turning now to FIG. 4 and as indicated above, the embodiments herein may include the controller 54. The controller 54 may be a computing device that includes processing circuitry that may further include an application specific integrated circuit (ASIC), an electronic circuit with one or more elemental circuit components such as resistors, an electronic processor (shared, dedicated, or group) 300 and memory 305 that executes one or more software algorithms or firmware algorithms and programs, contains relevant data which may be dynamically collected or disposed in one or more look-up tables, a combinational logic circuit that contains one or more operational amplifiers, and/or other suitable interfaces and components that provide the described functionality. For example, the processor 300 processes data stored in the memory 305 and employs the data in various control algorithms, diagnostics and the like.

The controller 54 may further include, in addition to a processor 300 and memory 305, one or more input and/or output (I/O) device interface(s) 310 that are communicatively coupled via an onboard (local) interface to communicate among the plurality of controllers. The onboard interface may include, for example but not limited to, an onboard system bus 315, including a control bus 320 (for inter-device communications), an address bus 325 (for physical addressing) and a data bus 330 (for transferring data). That is, the system bus 315 enables the electronic communications between the processor 300, memory 305 and I/O connections 310. The I/O connections 310 may also include wired connections and/or wireless connections. The onboard interface may have additional elements, which are omitted for simplicity, such as controllers, buffers (caches), drivers, repeaters, and receivers to enable electronic communications.

In operation, the processor 300 onboard the controller 54 may be configured to execute software algorithms stored within the memory 305, to communicate data to and from the memory 305, and to generally control computing operations pursuant to the software algorithms. The algorithms in the memory 305, in whole or in part, may be read by the processor 300, perhaps buffered within the processor 300, and then executed. The processor 300 may include hardware devices for executing the algorithms, particularly algorithms stored in memory 305. The processor 300 may be a custom made or a commercially available processor 300, a central processing units (CPU), an auxiliary processor among several processors associated with computing devices, semiconductor based microprocessors (in the form of microchips or chip sets), or generally any such devices for executing software algorithms.

The memory 305 onboard the controller 54 may include any one or combination of volatile memory elements (e.g., random access memory (RAM, such as DRAM, SRAM, SDRAM, VRAM, etc.)) and/or nonvolatile memory elements (e.g., ROM, hard drive, tape, CD-ROM, etc.). Moreover, the memory 305 may incorporate electronic, magnetic, optical, and/or other types of storage media. The memory 305 may also have a distributed architecture, where various components are situated remotely from one another, but may be accessed by the processor 300.

The software algorithms in the memory 305 onboard the controller 54 may include one or more separate programs, each of which includes an ordered listing of executable instructions for implementing logical functions. A system component embodied as software algorithms may be construed as a source program, executable program (object code), script, or any other entity comprising a set of instructions to be performed. When constructed as a source program, the software algorithms may be translated via a compiler, assembler, interpreter, or the like, which may or may not be included within the memory.

Some of the input/output (I/O) devices that may be coupled to the controller 54 using the system I/O Interface(s) 310, the wired interfaces and/or the wireless interfaces will now be identified but the illustration of which shall be omitted for brevity. Such I/O devices include, but are not limited to (i) input devices such as a keyboard, mouse, scanner, microphone, camera, proximity device, etc., (ii) output devices such as a printer, display, etc., and (iii) devices that communicate both as inputs and outputs, such as a modulator/demodulator (modem; for accessing another device, system, or network), a radio frequency (RF) or other transceiver, a telephonic interface, a bridge, a router, etc.

Further, using the wireless connection, the controller 54 may communicate over the network 400 to another controller 410 in another electronic device, for example, to report the lockout or the occurrence of an abnormal start. The wireless communication may occur by applying electronic short range communication (SRC) protocols. Such protocols may include local area network (LAN) protocols and/or a private area network (PAN) protocols. LAN protocols include WiFi technology, which is a technology based on the Section 802.11 standards from the Institute of Electrical and Electronics Engineers, or IEEE. PAN protocols include, for example, Bluetooth Low Energy (BTLE), which is a wireless technology standard designed and marketed by the Bluetooth Special Interest Group (SIG) for exchanging data over short distances using short-wavelength radio waves. PAN protocols also include Zigbee, a technology based on Section 802.15.4 protocols from the Institute of Electrical and Electronics Engineers (IEEE). More specifically, Zigbee represents a suite of high-level communication protocols used to create personal area networks with small, low-power digital radios for low-power low-bandwidth needs, and is best suited for small scale projects using wireless connections. Such wireless connection 330 may include Radio-frequency identification (RFID) technology, which is another SRC technology used for communicating with an integrated chip (IC) on an RFID smartcard.

One should note that the above disclosed architecture, functionality, and/or hardware operations of the controller 54 may be implemented using software algorithms. In the software algorithms, such functionality may be represented as a module, segment, or portion of code, which comprises one or more executable instructions for implementing the specified logical function(s). It should also be noted that such modules may not necessarily be executed in any particular order and/or executed at all.

One should also note that any of the functionality of the controller 54 described herein can be embodied in any non-transitory computer-readable medium for use by or in connection with an instruction execution system, apparatus, or device, such as a computer-based system, processor-containing system, or other system that can fetch the instructions from the instruction execution system, apparatus, or device and execute the instructions. In the context of this document, a "computer-readable medium" contains, stores, communicates, propagates and/or transports the program for use by or in connection with the instruction execution system, apparatus, or device.

Further, the computer readable medium in the controller 54 may include various forms of computer readable memory 305. For example the computer readable memory 305 may be integral to an apparatus or device, which may include one or more semiconductors, and in which the communication and/or storage technology may be one or more of electronic, magnetic, optical, electromagnetic or infrared. More specific examples (a non-exhaustive list) of a computer-readable medium the illustration of which being omitted for brevity include a portable computer diskette (magnetic), a random access memory (RAM) (electronic), a read-only memory (ROM) (electronic), an erasable programmable read-only memory (EPROM or Flash memory) (electronic), and a portable compact disc read-only memory (CDROM) (optical).

The term "about" is intended to include the degree of error associated with measurement of the particular quantity based upon the equipment available at the time of filing the application.

The terminology used herein is for the purpose of describing particular embodiments only and is not intended to be limiting of the present disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, element components, and/or groups thereof While the present disclosure has been described with reference to an exemplary embodiment or embodiments, it will be understood by those skilled in the art that various changes may be made and equivalents may be substituted for elements thereof without departing from the scope of the present disclosure. In addition, many modifications may be made to adapt a particular situation or material to the teachings of the present disclosure without departing from the essential scope thereof. Therefore, it is intended that the present disclosure not be limited to the particular embodiment disclosed as the best mode contemplated for carrying out this present disclosure, but that the present disclosure will include all embodiments falling within the scope of the claims.

What is claimed is:

1. A furnace, the furnace being an induced-draft gas-fired furnace, the furnace comprising:

a controller, the controller being an electronic furnace controller, a burner assembly, a gas valve, and an inducer motor, wherein the controller:

accelerates the inducer motor at a first pre-ignition rate to a first pre-ignition speed;

controls the gas valve to supply gas to the burner assembly to obtain a first pre-ignition ratio of fuel to air, operates an igniter to attempt to ignite the first fuel mixture, determines whether fuel having the first pre-ignition ratio of fuel to air has ignited in the burner assembly, wherein when fuel having the first pre-ignition ratio of fuel to air remains unignited after a plurality of ignition attempts, the controller:

decelerates the inducer motor to a second pre-ignition rate to obtain a second pre-ignition speed and a second fuel mixture comprising a second pre-ignition ratio of fuel to air, and determines whether the second fuel mixture has ignited in the burner assembly.

2. The furnace of claim 1 wherein when fuel having the second pre-ignition ratio of fuel to air remains unignited in the burner assembly the controller locks out the furnace.

3. The furnace of claim 2 wherein when fuel having the first pre-ignition ratio of fuel to air has ignited in the burner assembly, the controller accelerates the inducer motor at a first post-ignition rate to obtain a first post-ignition speed and a first post-ignition fuel to air ratio, wherein the first post-ignition rate provides steady state acceleration, and wherein the controller controls the furnace to heat air with the inducer burner at the first post-ignition speed.

4. The furnace of claim 3 wherein when fuel having the second ratio of fuel to air has ignited in the burner assembly the controller accelerates the inducer motor at a second post-ignition rate to obtain a second post-ignition speed and a second post-ignition fuel to air ratio, accelerates the inducer motor at a third post-ignition rate to obtain a third post-ignition speed and a third fuel to air ratio, wherein the third-post ignition rate provides steady state acceleration, wherein the third post-ignition rate is less than the second post-ignition rate, and wherein the controller controls the furnace to heat air with the inducer motor at the third post-ignition speed.

5. The furnace of claim 4 wherein the first pre-ignition rate, the second pre-ignition rate and the second post-ignition rate have same magnitude.

6. The furnace of claim 5 wherein the first post-ignition rate and the third post-ignition rate have the same magnitude.

7. The furnace of claim 6 wherein the first post-ignition speed and the third-post ignition speed have the same magnitude.

8. The furnace of claim 7 wherein the first pre-ignition fuel to air ratio and the second post-ignition fuel to air ratio have the same magnitude.

9. The furnace of claim 8 wherein the burner assembly includes a premix ultra low NoX burner.

10. The furnace of claim 9 wherein the controller receives a pre-ignition call for heat before accelerating the inducer motor at the first pre-ignition rate to the first pre-ignition speed.

11. A method of igniting a gas burner in a furnace, the furnace being an induced-draft gas-fired furnace, the furnace including a controller, the controller being an electronic furnace controller, the furnace further including a burner assembly, a gas valve and an inducer motor, the method includes comprising the furnace controller:

accelerating the inducer motor at a first pre-ignition rate to a first pre-ignition speed;

controlling the gas valve to supply gas to the burner assembly to obtain a first pre-ignition ratio of fuel to air, operating an igniter to attempt to ignite the fuel having the first pre-ignition ratio of fuel to air, determining whether fuel having the first pre-ignition ratio of fuel to air has ignited in the burner assembly, wherein when fuel having the first pre-ignition ratio of fuel to air remains unignited after a plurality of ignition attempts, the method further includes the furnace controller:

decelerating the inducer motor to a second pre-ignition rate to a second pre-ignition speed so that a second pre-ignition ratio of fuel to air is achieved, and determining whether fuel having the second pre-ignition ratio of fuel to air has ignited in the burner assembly.

12. The method of claim 11 wherein when fuel having the second pre-ignition ratio of fuel to air remains unignited in the burner assembly the method includes locking out the furnace.

13. The method of claim 12 wherein when fuel having the first pre-ignition ratio of fuel to air has ignited in the burner assembly, the method includes the controller accelerating the inducer motor at a first post-ignition rate to obtain a first post-ignition speed and a first post-ignition fuel to air ratio, wherein the first post-ignition rate provides steady state acceleration, and wherein the method includes the controller controlling the furnace to heat air with the inducer burner at the first post-ignition speed.

14. The method of claim 13 including wherein when fuel having the second ratio of fuel to air has ignited in the burner assembly the method includes accelerating the inducer motor at a second post-ignition rate to obtain a second post-ignition speed and a second post-ignition fuel to air ratio, accelerating the inducer motor at a third post-ignition rate to obtain a third post-ignition speed and a third fuel to air ratio, wherein the third-post ignition rate provides steady state acceleration, and wherein the third post-ignition rate is less than the second post-ignition rate, and wherein the method further includes the controller controlling the furnace to heat air with the inducer motor at the third post-ignition speed.

15. The method of claim 14 wherein the first pre-ignition rate, the second pre-ignition rate and the second post-ignition rate have same magnitude.

16. The method of claim 15 wherein the first post-ignition rate and the third post-ignition rate have the same magnitude.

17. The method of claim 16 wherein the first post-ignition speed of the inducer motor and the third-post ignition speed of the inducer motor have the same magnitude.

18. The method of claim 17 wherein the first pre-ignition fuel to air ratio and the second post-ignition fuel to air ratio have the same magnitude.

19. The method of claim 18 wherein the burner assembly includes a premix ultra low NoX burner.

20. The method of claim 19 wherein the controller receives a pre-ignition call for heat before accelerating the inducer motor at the first pre-ignition rate to the first pre-ignition speed.

* * * * *